US012104360B2

(12) United States Patent
Kameoka et al.

(10) Patent No.: US 12,104,360 B2
(45) Date of Patent: Oct. 1, 2024

(54) CONSTRUCTION MACHINE

(71) Applicant: HITACHI CONSTRUCTION MACHINERY CO., LTD., Tokyo (JP)

(72) Inventors: Ryota Kameoka, Ibaraki (JP); Shinji Nishikawa, Ibaraki (JP); Akihiro Narazaki, Ibaraki (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 415 days.

(21) Appl. No.: 17/640,928

(22) PCT Filed: Oct. 28, 2020

(86) PCT No.: PCT/JP2020/040457
§ 371 (c)(1),
(2) Date: Mar. 7, 2022

(87) PCT Pub. No.: WO2021/085479
PCT Pub. Date: May 6, 2021

(65) Prior Publication Data

US 2022/0333356 A1 Oct. 20, 2022

(30) Foreign Application Priority Data

Oct. 31, 2019 (JP) ..... 2019-198855

(51) Int. Cl.
*E02F 9/26* (2006.01)
*E02F 3/43* (2006.01)
*E02F 9/20* (2006.01)

(52) U.S. Cl.
CPC ..... *E02F 9/262* (2013.01); *E02F 3/435* (2013.01); *E02F 9/2033* (2013.01)

(58) Field of Classification Search
CPC ..... E02F 9/262; E02F 9/2033; E02F 9/2296; E02F 9/20; E02F 9/24; E02F 9/26; E02F 3/435; E02F 3/43
See application file for complete search history.

(56) References Cited

U.S. PATENT DOCUMENTS

2016/0312434 A1 10/2016 Shintani et al.
2018/0024563 A1* 1/2018 Matsuzaki ..... G05D 1/0214 701/41

(Continued)

FOREIGN PATENT DOCUMENTS

CN 109313840 A 2/2019
JP 08246493 A 9/1996

(Continued)

OTHER PUBLICATIONS

Chinese Office Action received in corresponding Chinese Application No. 202080060889.6 dated Oct. 24, 2022.

(Continued)

*Primary Examiner* — Khoi H Tran
*Assistant Examiner* — Nhi Q Bui
(74) *Attorney, Agent, or Firm* — MATTINGLY & MALUR, PC

(57) ABSTRACT

Provided is a construction machine that avoids automatic release of operation restriction involving, for example, sudden acceleration unintended by an operator even when an inclined angle of a vehicle body changes. The construction machine includes a vehicle body 50 configured to operate, 3D sensors (obstacle detection devices) 5, 6, 7, and 8 that detect an obstacle present around the vehicle body 50, an inclined angle determination device (an inclined angle detection device) 9 that detects the inclined angle of the vehicle body 50, and a vehicle body controller (a controller) 14 having an operation restriction function that performs a restriction control to restrict an operation of the vehicle body 50 when the 3D sensors (the obstacle detection devices) 5, 6, 7, and 8 detect an obstacle. When the inclined angle of the vehicle body 50 exceeds a predetermined threshold while the restriction control is not performed with the operation restriction function, the vehicle body controller (the controller) 14 disables the operation restriction function. When the inclined angle of the vehicle body 50 exceeds the predetermined threshold while the restriction control is performed (Continued)

with the operation restriction function, the vehicle body controller (the controller) 14 does not disable the operation restriction function.

4 Claims, 13 Drawing Sheets

(56) References Cited

U.S. PATENT DOCUMENTS

| | | | | |
|---|---|---|---|---|
| 2019/0127946 | A1 | 5/2019 | Sakai et al. | |
| 2019/0241124 | A1 | 8/2019 | Izumikawa et al. | |
| 2019/0284782 | A1* | 9/2019 | Izumikawa | F15B 11/10 |
| 2020/0032488 | A1* | 1/2020 | Kean | E02F 9/262 |
| 2021/0116601 | A1* | 4/2021 | Sherlock | G06Q 50/08 |

FOREIGN PATENT DOCUMENTS

| | | | |
|---|---|---|---|
| JP | 08269998 | A | 10/1996 |
| JP | 2018003514 | A | 1/2018 |
| WO | 2016125232 | A1 | 8/2016 |

OTHER PUBLICATIONS

International Search Report of PCT/JP2020/040457 dated Jan. 19, 2021.

* cited by examiner

CONSTRUCTION MACHINE

TECHNICAL FIELD

The present invention relates to a construction machine and especially relates to a construction machine having a function of restricting operations of turning and traveling when a person or an object is detected around the construction machine.

BACKGROUND ART

There has been proposed a construction machine that includes a sensor detecting a person and an object around the construction machine. The construction machine has a function (hereinafter referred to as an operation restriction function in some cases) that slows or stops operations of turning and traveling when the sensor detects a person or an object to avoid a contact of the construction machine with the surrounding person and object.

In a case where the construction machine having the function detects a person during the operation on a slope ground and the operation restriction is actuated, an operating speed suddenly decelerates, and the vehicle body possibly loses the balance due to the back action. As described above, to avoid the balance of the vehicle body to be lost, a technique that disables control of restricting operations on a slope ground has been proposed.

Patent Literature 1 proposes a function that avoids a falling by releasing area restriction control when a construction machine having an area restriction control function determines that there is a possibility of falling on a slope ground based on information of a vehicle body inclined angle.

In a similar way of thinking, it is considered to apply the proposed technique to a construction machine having a function of detecting an obstacle and restricting operations and to take a measure of disabling the operation restriction when an inclined angle of a vehicle body is large.

CITATION LIST

Patent Literature

Patent Literature 1: JP H08-269998 A

SUMMARY OF INVENTION

Technical Problem

However, as in Patent Literature 1, in the case where the configuration of automatically releasing the operation restriction when the inclination increases is employed, when the inclined angle of the vehicle body increases due to an entrance to a slope, the operation restriction is automatically released by traveling with the operation restriction actuated. This causes sudden acceleration unintended by an operator, giving uncomfortable feeling to the operator. Additionally, in a case where the operation restriction is suddenly released near an obstacle, a speed of approaching the obstacle becomes fast contrary to consciousness of the operator.

An object of the present invention is to provide a construction machine that avoids automatic release of operation restriction involving, for example, sudden acceleration unintended by an operator even when an inclined angle of a vehicle body changes.

Solution to Problem

In order to solve the problem, a construction machine according to the present invention comprises a vehicle body, an obstacle detection device, an inclined angle detection device, and a controller. The vehicle body is configured to operate. The obstacle detection device detects an obstacle present around the vehicle body. The inclined angle detection device detects an inclined angle of the vehicle body. The controller has an operation restriction function that performs a restriction control to restrict an operation of the vehicle body when the obstacle detection device detects an obstacle. When the inclined angle of the vehicle body exceeds a predetermined threshold while the restriction control is not performed with the operation restriction function, the controller disables the operation restriction function. When the inclined angle of the vehicle body exceeds the predetermined threshold while the restriction control is performed with the operation restriction function, the controller does not disable the operation restriction function.

Advantageous Effects of Invention

According to the present invention, the operation restriction function is disabled when the vehicle body enters a slope ground with the operation restriction not actuated while the operation restriction function is not disabled when the vehicle body enters a slope ground with the operation restriction actuated. For example, after an operator sets an operating lever in a non-operation state, the operator releases the restriction control to disable the operation restriction function. Thus, automatic release of the operation restriction involving, for example, sudden acceleration unintended by the operator can be avoided.

Problems, configurations, and effects other than ones described above will be clarified in the following explanation of embodiments.

DESCRIPTION OF EMBODIMENTS

Figure 1:
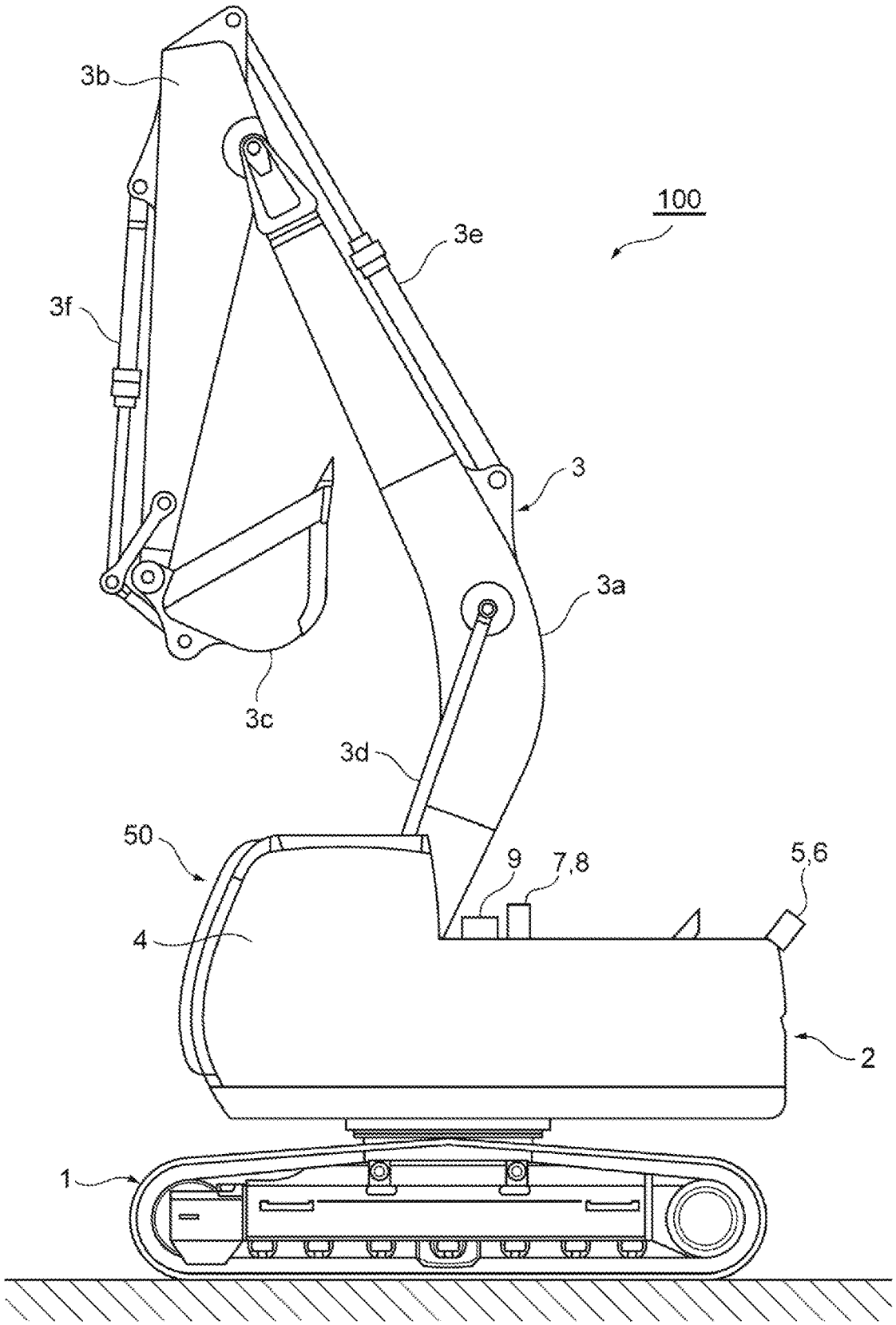
FIG. 1 is a drawing illustrating an appearance of a hydraulic shovel illustrated as one example of a construction machine according to an embodiment of the present invention.

Embodiments of the present invention will be described below by referring to the accompanying drawings. In each drawing, the same reference numeral is given to a part having the same function and the repeated description is omitted in some cases. Note that, directions of front, rear, left, right, up, and down described in this Description mean directions viewed from an operator who gets in (a driver's seat) of a construction machine. While a hydraulic shovel configured to perform operations of traveling and turning will be described as one example of the construction machine in this embodiment, the construction machine is not limited to the hydraulic shovel, and this embodiment is obviously applicable to general construction machines.

Description of Hydraulic Shovel

FIG. 1 is a drawing illustrating an appearance of the hydraulic shovel illustrated as one example of the construction machine according to the embodiment of the present invention.

In FIG. 1, a hydraulic shovel (a construction machine) 100 roughly includes a crawler lower traveling body 1, an upper turning body 2 turnably disposed to the lower traveling body 1, and a front working machine 3 that includes, for example, excavation work means.

A pair of right and left hydraulic motors for traveling (also referred to as traveling motors) (not illustrated in FIG. 1) are disposed in the lower traveling body 1. Each of crawlers is independently rotatably driven by these hydraulic motors for traveling, a speed reducing mechanism thereof, and the like for traveling forward or backward.

The upper turning body 2 includes a driver's cabin 4 in which an operating device to perform various kinds of operations of the hydraulic shovel 100, a driver's seat on which the operator is seated, and the like are disposed, a power engine, such as an engine, a hydraulic pump and a turning motor (not illustrated in FIG. 1), and the like. With this turning motor, the upper turning body 2 is turned in the right direction or the left direction with respect to the lower traveling body 1. The driver's cabin 4 internally includes various kinds of meters and gauges and a display device (not illustrated in FIG. 1) that displays machine body information so that the operator can confirm the situation of the hydraulic shovel (the construction machine) 100.

The front working machine 3 is elevatably mounted on the front portion of the upper turning body 2. The front working machine 3 is constituted of a boom 3*a*, an arm 3*b*, and a bucket 3*c*. The boom 3*a* is moved up and down with a boom cylinder 3*d*, the arm 3*b* is operated to a dump side (an open side) or a crowd side (a shoveling side) with an arm cylinder 3*e*, and the bucket 3*c* is operated to the dump side or the crowd side with a bucket cylinder 3*f*.

The above-described lower traveling body 1 and upper turning body 2 (on which the front working machine 3 is disposed) constitute a vehicle body 50 configured to perform the operations of traveling and turning.

Description of Obstacle Detection Device

On the rear end of the hydraulic shovel 100 and on the left end and the right end of the vehicle body 50, 3D sensors 5, 6, 7, and 8 as the obstacle detection devices to detect an obstacle present around the vehicle body 50 are mounted. The 3D sensor is an infrared sensor in a light pulse time-of-flight measurement method (TOF) that can determine whether an object is detected/not detected in a predetermined detection region, determine whether it is during obstacle detection inside the sensor, and output the determination result by CAN communication.

Description of Inclined Angle Determination Device

On the vehicle body 50 at the turning center of the hydraulic shovel 100, an inclined angle determination device (an inclined angle detection device) 9 to acquire (detect) inclined angle information of the vehicle body 50 is mounted. The inclined angle determination device is constituted of an Inertial Measurement Unit (IMU) and a controller that operates the inclined angle. Here, an acceleration and an angular speed are output from the IMU, the controller operates the output acceleration and angular speed to calculate a roll angle and a pitch angle. The controller synthesizes the roll angle and the pitch angle to operate the inclined angle of the vehicle body 50, and outputs the value of the inclined angle by CAN communication.

Description of Obstacle Detection Device and Detection Regions

Figure 2:
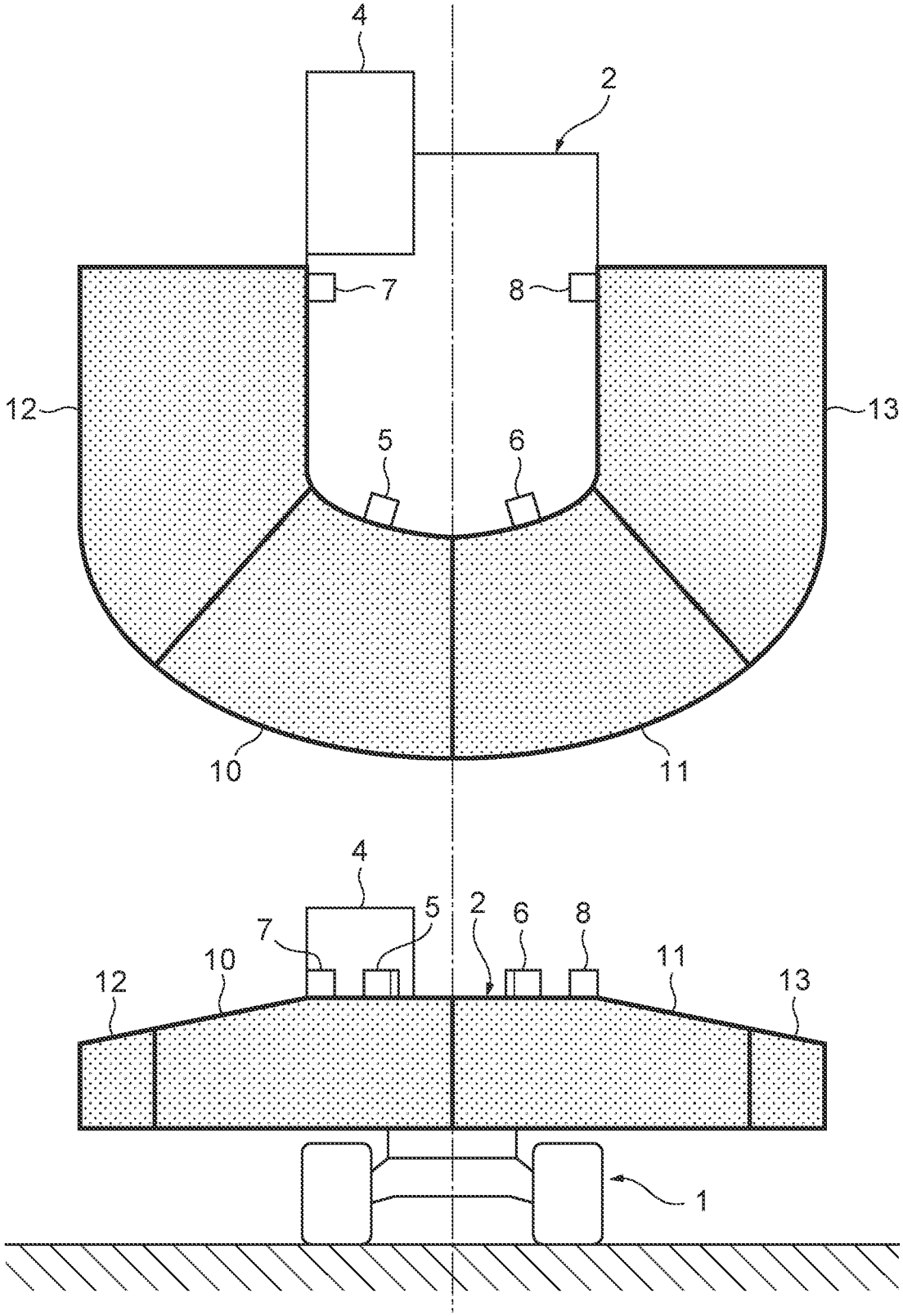
FIG. 2 is a drawing illustrating mounted positions and detection regions of obstacle detection devices according to the embodiment of the present invention.

FIG. 2 is a drawing illustrating mounted positions and the detection regions of the 3D sensors 5, 6, 7, and 8 as the obstacle detection devices.

The 3D sensor 5 is mounted at the left side of the rear end, the 3D sensor 6 is mounted at the right side of the rear end, the 3D sensor 7 is mounted at the left end, and the 3D sensor 8 is mounted at the right end of the vehicle body 50. Ranges (angles) that can be detected in the perpendicular direction and the horizontal direction are set to the 3D sensors 5, 6, 7, and 8, and a space at the rear of a peripheral area of the vehicle body 50 can be covered by the detection regions of the four 3D sensors 5, 6, 7, and 8. Using the detection regions of the respective 3D sensors 5, 6, 7, and 8, the detection regions to decrease a possibility of an accident caused by a contact of the hydraulic shovel 100 at the start of moving of the hydraulic shovel 100 with a peripheral worker are set. That is, the detection regions are set so as to allow detecting an obstacle present in the range in which the upper turning body 2 moves in a short period of the hydraulic shovel 100 starting moving for turning and traveling, and the range in which the 3D sensor 5 detects an obstacle is defined as a detection region 10, the range in which the 3D sensor 6 detects an obstacle is defined as a detection region 11, the range in which the 3D sensor 7 detects an obstacle is defined as a detection region 12, and the range in which the 3D sensor 8 detects an obstacle is defined as a detection region 13. The respective detection regions 10, 11, 12, and 13 are set as the detection regions of detecting an obstacle in a range of predetermined depth and width from the vehicle body 50 and a predetermined height or more (above the ground by the predetermined height)

such that the crawler of the lower traveling body 1 of the hydraulic shovel 100 itself is not detected as an obstacle.

Description of State Regarded as Obstacle Detection

The 3D sensors 5, 6, 7, and 8 determine whether an obstacle is present in the detection regions 10, 11, 12, and 13, respectively. The time point at which the 3D sensor determines that one or more obstacles (a person, a substance) are present in the area of the detection regions 10, 11, 12, or 13 created by the 3D sensors 5, 6, 7, or 8 as the obstacle detection device is regarded as "during obstacle detection" in this embodiment.

Figure 3:
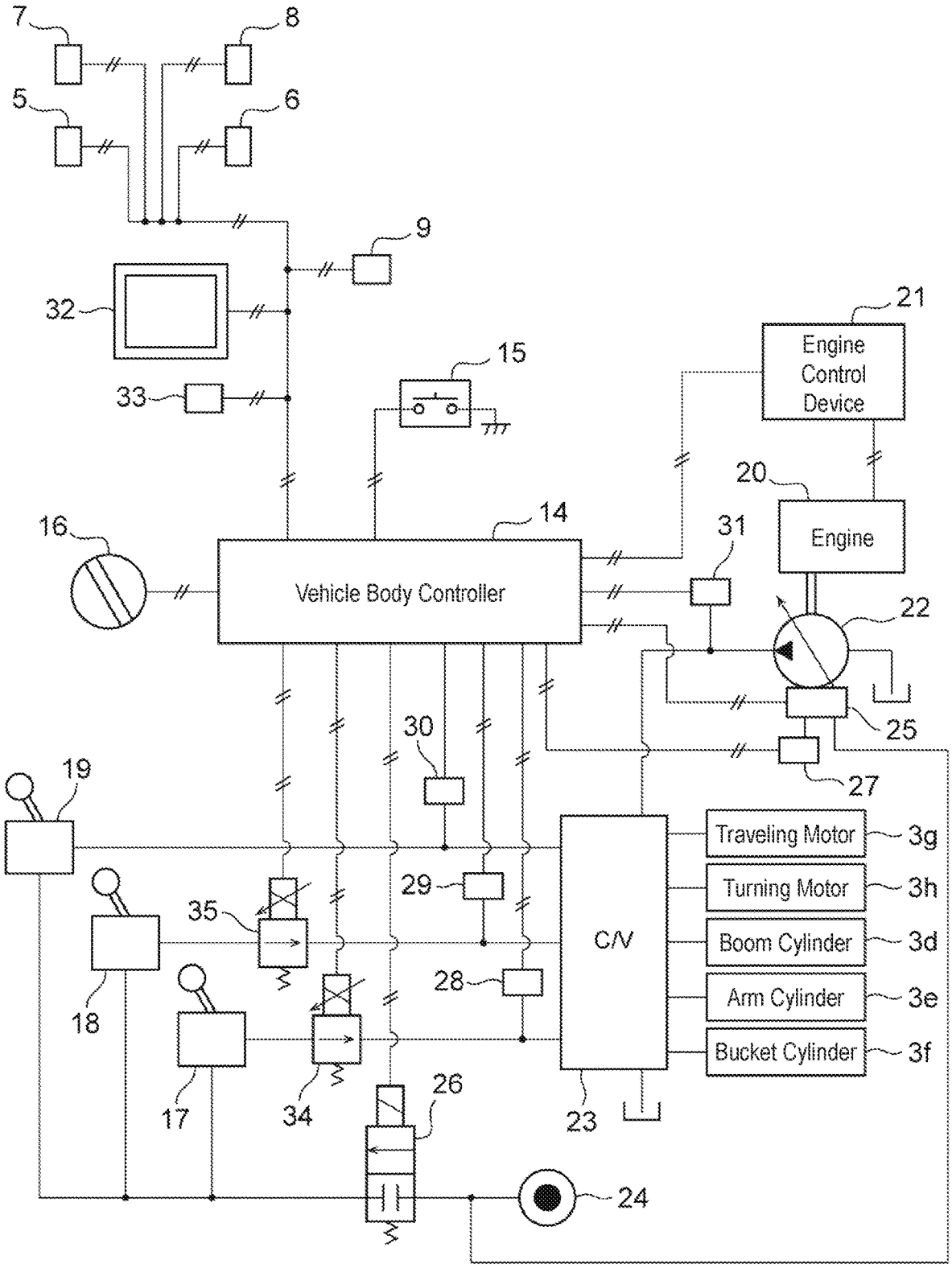
FIG. 3 is a drawing illustrating a system configuration according to the embodiment of the present invention.

Description of System Configuration: Constituent Parts as Usual Hydraulic Shovel FIG. 3 is a drawing illustrating the system configuration according to the embodiment of the present invention.

The driver's cabin 4 of the hydraulic shovel 100 of this embodiment internally includes a vehicle body controller 14 as a controller that controls the operation of the entire machine body, a lock switch 15 as a lever switch to switch operation lock means that switches operability of all operations of the vehicle body 50, and an engine control dial 16 to manually change an engine rotation speed.

The driver's cabin 4 of the hydraulic shovel 100 also internally includes an operating device that performs the various kinds of operations of the hydraulic shovel 100. FIG. 3 representatively illustrates three operating levers as the operating devices, which are a turning operating lever 17, a traveling operating lever 18, and a front operating lever 19. The turning operating lever 17 represents one of the left turn operation and the right turn operation. The traveling operating lever 18 represents one of a right forward traveling operation, a right backward traveling operation, a left forward traveling operation, and a left backward traveling operation. The front operating lever 19 representants one of a boom raising operation, a boom lowering operation, an arm crowd operation, an arm dump operation, a bucket crowd operation, and a bucket dump operation. The following will collectively describe the turning operating lever 17, which operates an actuator that causes the vehicle body 50 to turn (the left turn and the right turn), the traveling operating lever 18, which operates an actuator to cause the vehicle body 50 to travel (the right forward traveling, the right backward traveling, the left forward traveling, and the left backward traveling), and the front operating lever 19, which operates an actuator that causes the front working machine 3 to operate (the boom rising, the boom lowering, the arm crowd, the arm dump, the bucket crowd, and the bucket dump) as the operating levers 17, 18, and 19 in some cases.

The hydraulic shovel 100 of this embodiment includes an engine 20 as a power engine. An engine control device 21 electrically connected to the engine 20 grasps the state of the engine 20 from signals of a temperature sensor and a pick-up sensor built in the engine 20 and controls a valve or the like to control the rotation speed and a torque.

The vehicle body controller 14 and the engine control device 21 are connected by CAN communication and each of them transmits and receives required information. For example, regarding engine rotation speed control, the vehicle body controller 14 determines a target engine rotation speed according to an engine control dial voltage, the operating states of the operating levers, a pump load state, and a temperature condition, and transmits the target engine rotation speed to the engine control device 21. The engine control device 21 controls the engine 20 such that the engine rotation speed becomes the target engine rotation speed, operates the actual engine rotation speed from the signal of the pick-up sensor built in the engine 20, and transmits the actual engine rotation speed to the vehicle body controller 14.

Hydraulic oil discharged from a variable capacity hydraulic pump 22 driven by the engine 20 passes through a control valve 23 that controls a flow of the oil to each of hydraulic actuators, and is supplied to a traveling motor 3*g* as the hydraulic actuator to travel the vehicle body 50, a turning motor 3*h* as the hydraulic actuator to turn the vehicle body 50, and the boom cylinder 3*d*, the arm cylinder 3*e*, and the bucket cylinder 3*f* as the hydraulic actuators to operate the boom 3*a*, the arm 3*b*, and the bucket 3*c* constituting the front working machine 3.

Note that, for example, in consideration of a situation in which the plurality of actuators are simultaneously operated, the usual hydraulic shovel 100 includes two hydraulic pumps. However, FIG. 3 representatively illustrates one of them. The first one of the pumps, which is a first pump discharges hydraulic oil used to drive the boom, the arm, the bucket, and the right traveling (namely, the right side crawler). The second one of the pumps, which is a second pump discharges hydraulic oil used to drive the boom, the arm, the turning, and the left traveling (namely, the left side crawler).

The operating levers 17, 18, and 19 are pilot valves as manual pressure reducing valves that decompress primary pressures according to amounts of operation of the operating levers 17, 18, and 19 and generate pilot valve secondary pressures. The generated secondary pressures move a plurality of spools (direction switching valves) inside the control valve 23, and thus the flow of the hydraulic oil discharged from the hydraulic pump 22 is adjusted, thereby allowing the operation of the corresponding actuator.

A hydraulic pressure source 24 from the pilot pump driven by the engine 20 is supplied to a pump regulator 25 and a lock valve 26 as the operation lock means, and a pilot primary pressure (4 MPa) is maintained by a pilot relief valve (not illustrated).

The pump regulator 25 internally includes a pump flow rate control solenoid valve as an electromagnetic proportional valve that decompresses the pilot primary pressure from the hydraulic pressure source 24 for use and decompresses the pilot primary pressure according to a current (mA) output from the vehicle body controller 14. The pump regulator 25 builds in a tilt (a displacement volume) control mechanism of the hydraulic pump 22 that controls the volume of the hydraulic pump 22, namely, the discharge flow rate, according to a pump flow rate control pressure as the output (the secondary pressure) of the pump flow rate control solenoid valve.

The pump regulator 25 has a property in which the pump volume is minimized at the minimum (0 MPa) pump flow rate control pressure, and the pump volume is maximized at the maximum (4 MPa) pump flow rate control pressure.

The pump flow rate control solenoid valve is at a shut-off position (0 MPa) in a non-control state (0 mA), and has a property of increasing the pump flow rate control pressure as the vehicle body controller 14 increases a command current. The pump regulator 25 includes a pump flow rate control pressure sensor 27 to detect the pump flow rate control pressure.

The lock valve 26 is the operation lock means that switches operability of all operations of the vehicle body 50. The lock valve 26 is switched between the shut-off position and a circuit communication position with a solenoid driven by the vehicle body controller 14. While a lock lever (not illustrated) installed inside the driver's cabin 4 is at a lock position, the lock switch 15 is in an OFF (open between terminals) state. The vehicle body controller 14 monitors the state of the lock switch 15, and sets the lock valve 26 at the shut-off position in a non-excitation state while the lock switch 15 is OFF. While the lock lever (not illustrated) installed inside the driver's cabin 4 is at a lock release position, the lock switch 15 is in an ON (the terminals are electrically conductive) state. The vehicle body controller 14 monitors the state of the lock switch 15, and applies 24 V to the lock valve 26 while the lock switch 15 is ON to set the lock valve 26 at the circuit communication position in an excitation state.

While the lock valve 26 is at the shut-off position, the pilot primary pressure is not supplied to the turning operating lever 17, the traveling operating lever 18, or the front operating lever 19. Therefore, even when the operating lever 17, 18, or 19 is operated, the pilot valve secondary pressure does not increase and the spools inside the control valve 23 cannot be switched, and thus all operations of the vehicle body 50 are disabled.

While the lock valve 26 is at the circuit communication position, the pilot primary pressure is supplied to the turning operating lever 17, the traveling operating lever 18, and the front operating lever 19. Therefore, the pilot valve secondary pressure increases according to the operations of the operating levers 17, 18, and 19 and the spools inside the control valve 23 can be switched, and thus the vehicle body 50 can be operated.

A pilot circuit between the turning operating lever 17 and the control valve 23 includes a turning operation pressure sensor 28 to detect the pilot valve secondary pressure. A pilot circuit between the traveling operating lever 18 and the control valve 23 includes a traveling operation pressure sensor 29 to detect the pilot valve secondary pressure. A pilot circuit between the front operating lever 19 and the control valve 23 includes a front operation pressure sensor 30 to detect the pilot valve secondary pressure. Although the illustration is omitted, the front operation pressure sensor 30 includes each of a boom operation pressure sensor, an arm operation pressure sensor, and a bucket operation pressure sensor.

Signals of the turning operation pressure sensor 28, the traveling operation pressure sensor 29, and the front operation pressure sensor 30, namely, the boom operation pressure sensor, the arm operation pressure sensor, and the bucket operation pressure sensor are input to the vehicle body controller 14 and the vehicle body controller 14 grasps the operation situation of the hydraulic shovel 100. The vehicle body controller 14 includes the operating state determination unit (FIG. 4) as a control unit as operating state determination means. Simultaneously with the determination of presence/absence of the operation for each individual operation, when all of the operation pressure sensors determine that the operation is not performed, the operating state determination unit determines it as a non-vehicle body operation. Note that, the following will collectively describe the turning operation pressure sensor 28, the traveling operation pressure sensor 29, and the front operation pressure sensor 30 as operation pressure sensors 28, 29, and 30 in some cases.

In a delivery circuit between the hydraulic pump 22 and the control valve 23, a pump discharge pressure sensor 31 to detect the pump discharge pressure is disposed. A signal of the pump discharge pressure sensor 31 is input to the vehicle body controller 14, and the vehicle body controller 14 grasps a pump load of the hydraulic shovel 100.

The vehicle body controller 14 calculates a pump target flow rate by the operation according to the engine rotation speed and the inputs of the operation pressure sensors 28, 29, and 30. Additionally, the vehicle body controller 14 operates a restricted horsepower (kW) according to any vehicle body state (for example, a temperature) including the engine rotation speed and the operation situation, and calculates a pump upper limit flow rate by the horsepower restriction from the input of the pump discharge pressure sensor 31 and the restricted horsepower. The vehicle body controller 14 selects the smaller one among the pump target flow rate by the operation and the pump upper limit flow rate by the horsepower restriction as the pump target flow rate, and drives the pump flow rate control solenoid valve such that the flow rate becomes that flow rate.

Description of System Configuration: Constituent Part as Assumed Ambient Detection Operation Restriction System The driver's cabin 4 of the hydraulic shovel 100 internally includes an ambient detection monitor 32 and a warning buzzer 33 as display devices to notify the operator of detected information by the 3D sensors 5, 6, 7, and 8 and the state of the vehicle body operation restriction by ambient detection.

The 3D sensors 5, 6, 7, and 8, the ambient detection monitor 32, and the vehicle body controller 14 are connected by CAN communication and each of them transmits and receives required information. This CAN communication allows the vehicle body controller 14 and the ambient detection monitor 32 to know whether an obstacle is detected in each of the detection regions 10, 11, 12, and 13. Furthermore, in the case where one or more obstacles (a person, a substance) are present in the detection regions 10, 11, 12, and 13 created by the 3D sensors 5, 6, 7, and 8 as the obstacle detection devices, the vehicle body controller 14 determines it as during obstacle detection, and in the case where an obstacle (a person, a substance) is absent in all of the detection regions, the vehicle body controller 14 determines it as during non-obstacle detection.

A pilot circuit between the turning operating lever 17 and the control valve 23 includes a turning pilot pressure restriction solenoid valve 34 as one of vehicle body operation restriction means. The turning pilot pressure restriction solenoid valve 34 is in the circuit communication state during non-control (0 mA) and the increase in the current (mA) output from the vehicle body controller 14 restricts the pilot pressure, and thus the turning operation is restricted. A pilot circuit between the traveling operating lever 18 and the control valve 23 includes a traveling pilot pressure restriction solenoid valve 35 as one of the vehicle body operation restriction means. The traveling pilot pressure restriction solenoid valve 35 is in the circuit communication state during non-control (0 mA) and the increase in the current (mA) output from the vehicle body controller 14 restricts the pilot pressure, and thus the traveling operation is restricted.

The inclined angle determination device 9 is connected to the vehicle body controller 14 by CAN communication, and a value of the inclined angle acquired by the inclined angle determination device 9 is transmitted to the vehicle body controller 14. The vehicle body controller 14 determines whether the value of the inclined angle is an angle threshold or more at which the operation restriction function is disabled (described later). When the value of the inclined angle is the threshold or more, it is determined that the vehicle body 50 is inclined, and when the value of the inclined angle is less than the threshold, it is determined that the vehicle body 50 is not inclined.

Description of Configuration of Control Unit

Figure 4:
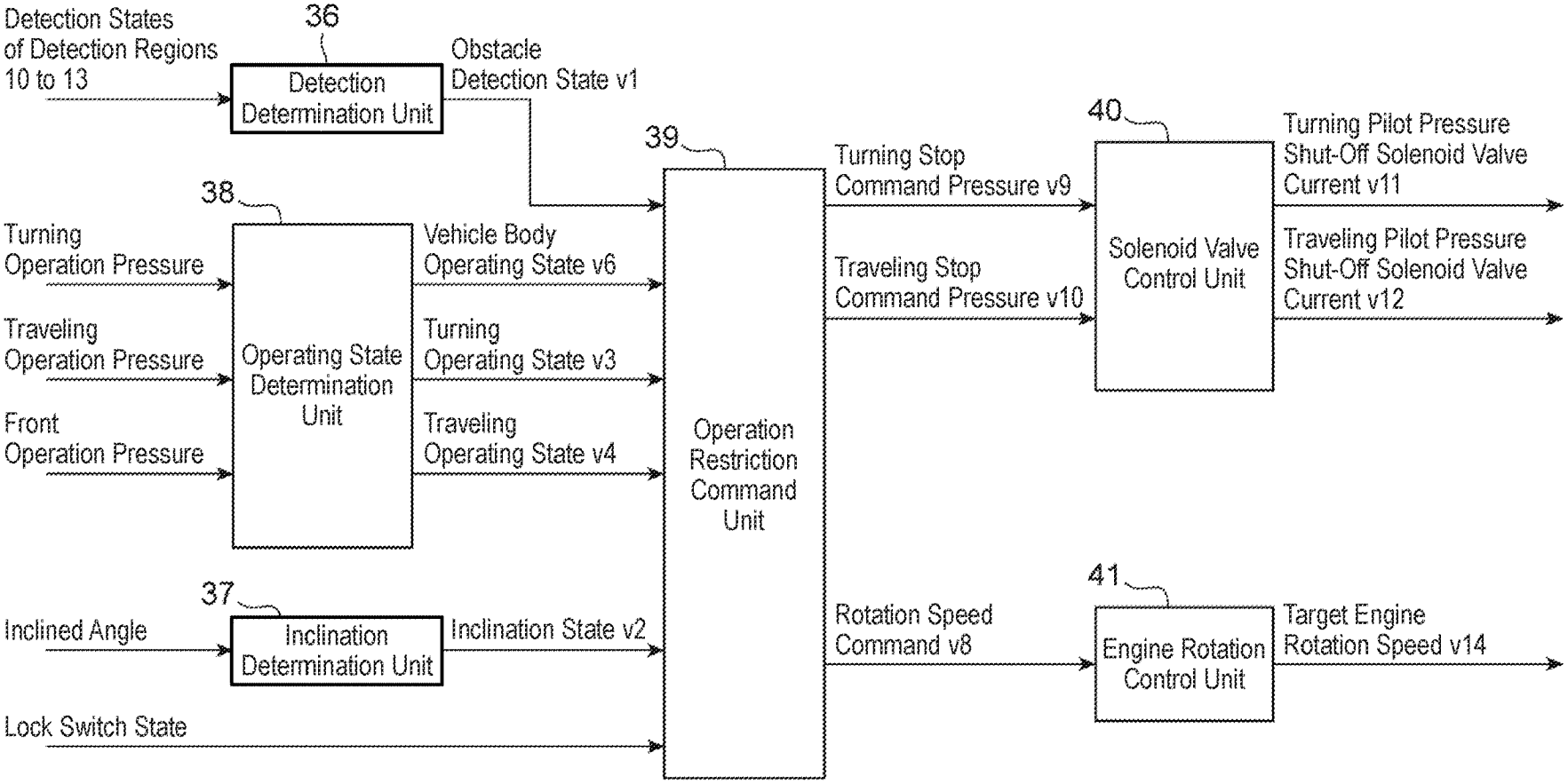
FIG. 4 is a drawing illustrating a configuration of a control unit related to operation restriction during obstacle detection according to the embodiment of the present invention.

FIG. 4 is a drawing illustrating the configuration of the control unit related to the operation restriction during obstacle detection according to the embodiment of the present invention.

Although the illustration is omitted, the vehicle body controller 14 as the controller is constituted as a microcomputer that includes a Central Processing Unit (CPU) performing various kinds of operations, a storage device, such as a Read Only Memory (ROM) and a Hard Disk Drive (HDD), storing programs to perform the operations by the CPU, a Random Access Memory (RAM) serving as a working area when the CPU executes the program, and the like. The respective functions of the vehicle body controller 14 are achieved by loading the various kinds of programs stored in the storage device into the RAM and executing the programs by the CPU.

In this embodiment, the vehicle body controller 14 has an operation restriction function that performs the restriction control of restricting (decelerating or stopping) the operations of the vehicle body 50 when an obstacle is detected in the peripheral area by the 3D sensors 5, 6, 7, and 8 as the obstacle detection devices.

A control unit in the vehicle body controller 14 includes, as control units to restrict the vehicle body operation during obstacle detection, a detection determination unit 36 that determines whether an obstacle (a person, a substance) is detected from the information of the detection state of the obstacle, an inclination determination unit 37 that determines whether the vehicle body 50 is inclined, and an operating state determination unit 38 that determines the operating state from the respective pieces of information (that is, the turning operation pressure, the traveling operation pressure, and the front operation pressure) of the turning operation pressure sensor 28, the traveling operation pressure sensor 29, and the front operation pressure sensor 30. Additionally, an operation restriction command unit 39 that issues a command for operation restriction based on the determination results of these determination units, a solenoid valve control unit 40 that outputs a shut-off solenoid valve current of the turning pilot pressure restriction solenoid valve 34 and the traveling pilot pressure restriction solenoid valve 35 in response to a solenoid valve command output from the operation restriction command unit 39, and an engine rotation control unit 41 that outputs the target engine rotation speed in response to an engine rotation speed command output from the operation restriction command unit 39 are disposed.

Detailed Description of Each Control Unit: Detection Determination Unit

Figure 5:
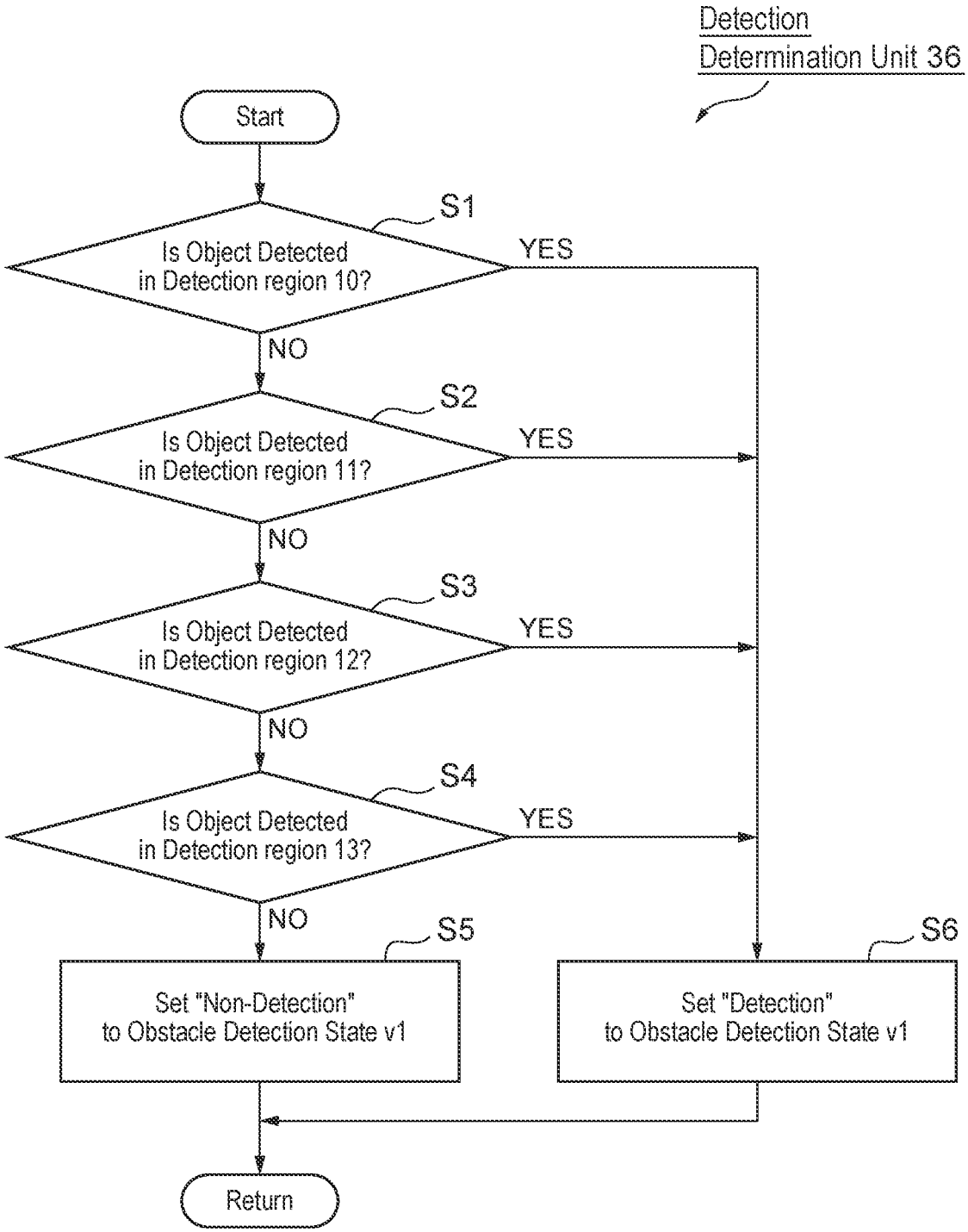
FIG. 5 is a flowchart depicting process content by a detection determination unit.

FIG. 5 is a flowchart depicting process content by the detection determination unit 36.

First, whether an object (a person, a substance) is detected in the range of the detection region 10 transmitted from the 3D sensor 5 is determined (S1). When the object is detected in the detection region 10, it is determined that the vehicle body 50 is in the detection state and an obstacle detection state v1 as a variable is set to "detection" (S6). When the object is not detected in the detection region 10, whether an object is detected in the range of the detection region 11 transmitted from the 3D sensor 6 is determined (S2). When the object is detected in the detection region 11, it is determined that the vehicle body 50 is in the detection state and the obstacle detection state v1 as the variable is set to "detection" (S6). When the object is not detected in the detection region 11, whether an object is detected in the range of the detection region 12 transmitted from the 3D sensor 7 is determined (S3). When the object is detected in the detection region 12, it is determined that the vehicle body 50 is in the detection state and the obstacle detection state v1 as the variable is set to "detection" (S6). When the object is not detected in the detection region 12, whether an object is detected in the range of the detection region 13 transmitted from the 3D sensor 8 is determined (S4). When the object is detected in the detection region 13, it is determined that the vehicle body 50 is in the detection state and the obstacle detection state v1 as the variable is set to "detection" (S6). When the object is detected in none of the detection regions 10, 11, 12, and 13, it is determined that the vehicle body 50 is in a non-detection state, and the obstacle detection state v1 as the variable is set to "non-detection" (S5).

The obstacle detection state v1, which is the determination result of the detection determination unit 36, is transmitted to the operation restriction command unit 39.

Detailed Description of Each Control Unit: Inclination Determination Unit

Figure 6:
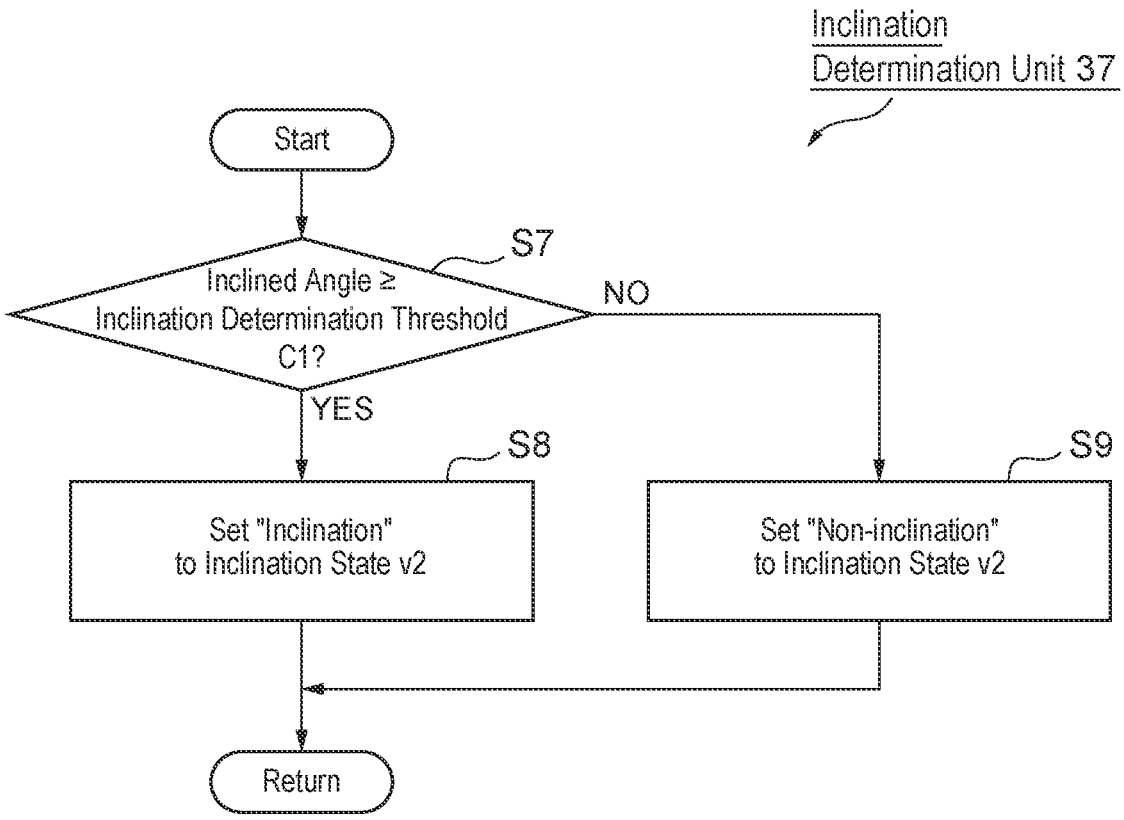
FIG. 6 is a flowchart depicting process content by an inclination determination unit.

FIG. 6 is a flowchart depicting process content by the inclination determination unit 37.

Whether the inclined angle transmitted from the inclined angle determination device 9 is an inclination determination threshold C1 (for example, nine degrees) or more is determined (S7). When the inclined angle is the inclination determination threshold C1 or more, it is determined that the vehicle body 50 is in the inclination state and an inclination state v2 is set to "inclination" (S8). When the inclined angle is less than the inclination determination threshold C1, it is determined that the vehicle body 50 is not inclined, and the inclination state v2 is set as "non-inclination" (S9).

Here, the inclination determination threshold C1 is set as an angle threshold to disable the operation restriction function performing the restriction control and is also set so as to be the inclined angle before the ground is detected in the ranges of the detection regions 10, 11, 12, and 13 transmitted from the 3D sensors 5, 6, 7, and 8 when the vehicle body 50 is inclined. That is, the angle smaller than the inclined angle of the vehicle body 50 when the detection regions 10, 11, 12, and 13 are in contact with the ground transmitted from the 3D sensors 5, 6, 7, and 8 by the inclination of the vehicle body 50 is set as the angle threshold (the inclination determination threshold C1) to disable the operation restriction function.

By thus setting the inclination determination threshold C1, even in a situation in which the vehicle body 50 is inclined and the ground is detected (the detection regions 10, 11, 12, or 13 is in contact with the ground), the operation restriction function is disabled before the detection regions 10, 11, 12, or 13 is in contact with the ground by a process described later. Accordingly, for example, in a case where the vehicle body 50 with the operation restriction not actuated travels, enters the slope ground, and start going up the slope, even when the inclined angle of the vehicle body 50 increases and the detection regions 10, 11, 12, or 13 detects the ground, the sudden deceleration of traveling unintended by the operator due to the actuation of the operation restriction does not occur, and the operator does not have uncomfortable feeling during the operation.

The inclination state v2 as the determination result of the inclination determination unit 37 is transmitted to the operation restriction command unit 39.

Detailed Description of Each Control Unit: Operating State Determination Unit

Figure 7:
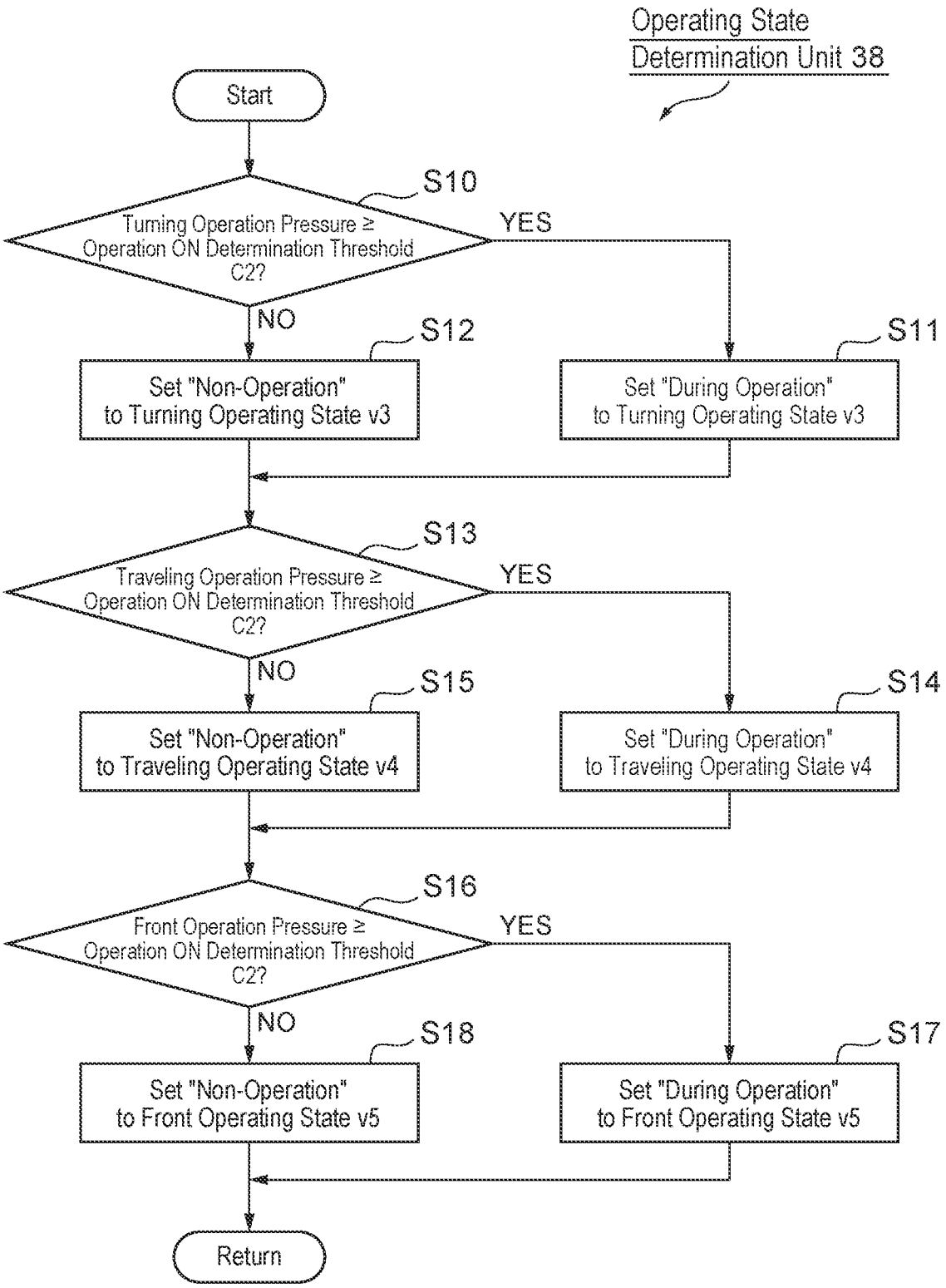
FIG. 7 is a flowchart depicting a part of determining an operating state of each operation in process content by an operating state determination unit.

FIG. 7 is a flowchart depicting a part of determining an operating state of each operation in process content by the operating state determination unit 38.

First, whether the turning operation pressure is an operation ON determination threshold C2 (for example, 0.5 MPa) or more is determined (S10). When the turning operation pressure is the operation ON determination threshold C2 or more, it is determined that the turning is in the operating state and a turning operating state v3 as a variable is set to "during operation" (S11). When the turning operation pressure is less than the operation ON determination threshold C2, it is determined that the turning is not in the operating state and the turning operating state v3 as the variable is set to "non-operation" (S12). Subsequently, whether the traveling operation pressure is the operation ON determination threshold C2 (for example, 0.5 MPa) or more is determined (S13). When the traveling operation pressure is the operation ON determination threshold C2 or more, it is determined that the traveling is in the operating state and a traveling operating state v4 as a variable is set to "during operation" (S14). When the traveling operation pressure is less than the operation ON determination threshold C2, it is determined that the traveling is not in the operating state and the traveling operating state v4 as the variable is set to "non-operation" (S15). Subsequently, whether the front operation pressure is the operation ON determination threshold C2 (for example, 0.5 MPa) or more is determined (S16). When the front operation pressure is the operation ON determination threshold C2 or more, it is determined that the front is in the operating state and a front operating state v5 as a variable is set to "during operation" (S17). When the front operation pressure is less than the operation ON determination threshold C2, it is determined that the front is not in the operating state and the front operating state v5 as the variable is set to "non-operation" (S18).

Figure 8:
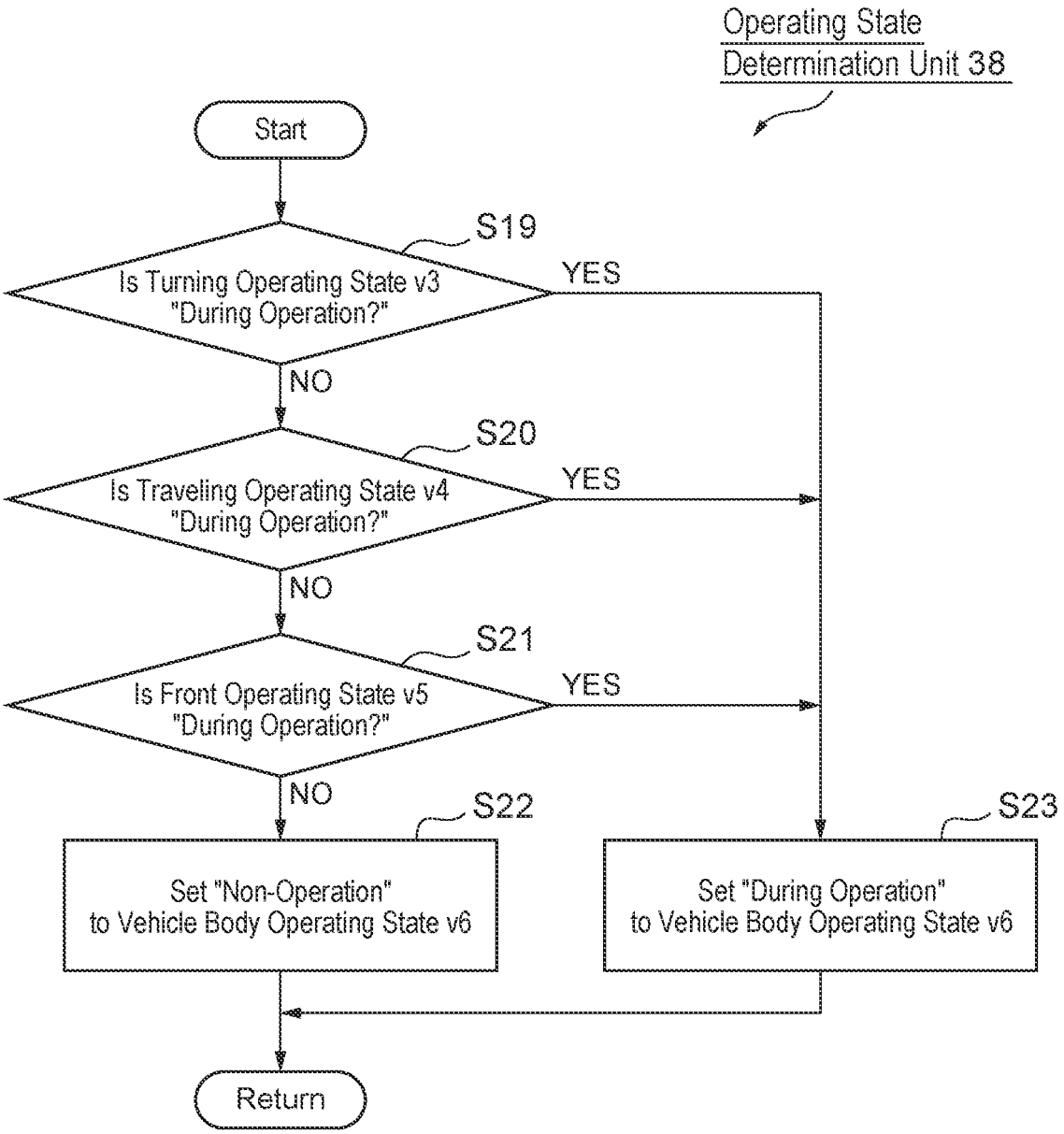
FIG. 8 is a flowchart depicting a part of determining an operating state as a vehicle body in the process content by the operating state determination unit.

FIG. 8 is a flowchart depicting a part of determining an operating state as a vehicle body in the process content by the operating state determination unit 38.

First, whether the turning operating state v3 is "during operation" is determined (S19). When the turning operating state v3 is "during operation," it is determined that the vehicle body 50 is in the operating state and a vehicle body operating state v6 as a variable is set to "during operation" (S23). When the turning operating state v3 is not "during operation" (is "non-operation"), whether the traveling operating state v4 is "during operation" is determined (S20). When the traveling operating state v4 is "during operation," it is determined that the vehicle body 50 is in the operating state and the vehicle body operating state v6 as the variable is set to "during operation" (S23). When the traveling operating state v4 is not "during operation" (is "non-operation"), whether the front operating state v5 is "during operation" is determined (S21). When the front operating state v5 is "during operation," it is determined that the vehicle body 50 is in the operating state and the vehicle body operating state v6 as the variable is set to "during operation" (S23). When all of the turning operating state v3, the traveling operating state v4, and the front operating state v5 are not "during operation" (are "non-operation"), it is determined that the vehicle body 50 is in the non-operation state and the vehicle body operating state v6 as the variable is set to "non-operation" (S22).

The turning operating state v3, the traveling operating state v4, and the vehicle body operating state v6 as the determination results of the operating state determination unit 38 are transmitted to the operation restriction command unit 39.

Detailed Description of Each Control Unit: Operation Restriction Command Unit

Figure 9:
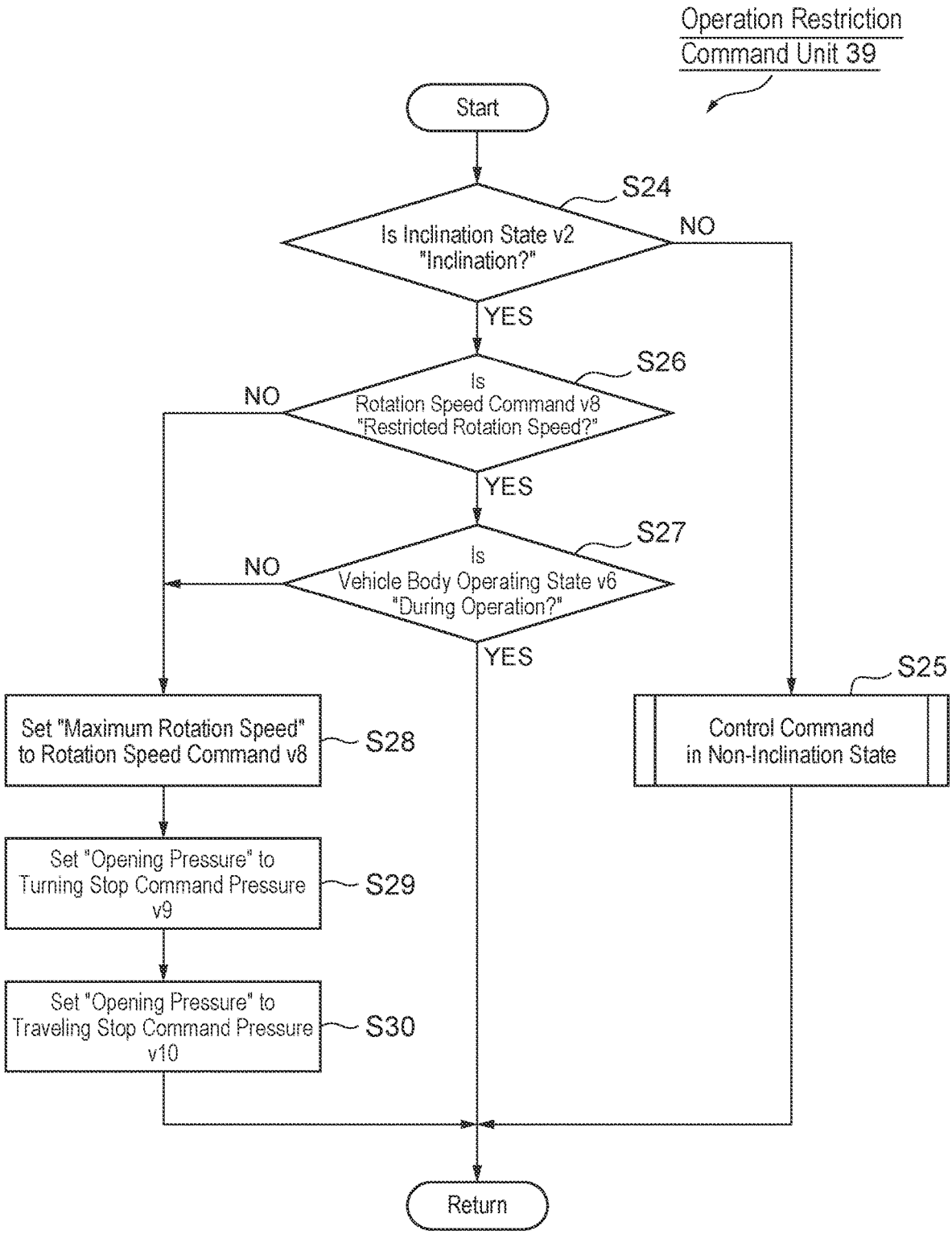
FIG. 9 is a flowchart depicting the entire process content by an operation restriction command unit.

FIG. 9 is a flowchart depicting the entire process content by the operation restriction command unit 39.

First, whether the inclination state v2 transmitted from the inclination determination unit 37 is "inclination" is determined (S24), and when the inclination state v2 is not "inclination" (is "non-inclination"), the process transitions to the control command in the non-inclination state (S25). The control command in the non-inclination state (S25) will be described later. When the inclination state v2 is "inclined," whether a rotation speed command v8 is a "restricted rotation speed" (for example, 800 rpm) (that is, whether the operation restriction is actuated and the restriction control is performed) is determined (S26). When the rotation speed command v8 is the "restricted rotation speed" (that is, the restriction control is performed), the process proceeds to the next Step S27. When the rotation speed command v8 is not the "restricted rotation speed" (that is, the restriction control is not performed), the rotation speed command v8 is set to the "maximum rotation speed" (for example, 2000 rpm) (S28), a turning stop command pressure v9 is set to an "opening pressure" (for example, 4 MPa) (S29), and a traveling stop command pressure v10 is set to the "opening pressure" (for example, 4 MPa) (S30). That is, when the rotation speed command v8 is not the "restricted rotation speed" (that is, the restriction control is not performed), the operation restriction function that performs the restriction control is disabled.

At Step S27, whether the vehicle body operating state v6 transmitted from the operating state determination unit 38 is "during operation" (that is, any of the operating levers 17, 18, and 19 is in the operating state) is determined. When the vehicle body operating state v6 is "during operation" (that is, any of the operating levers 17, 18, and 19 is operating), the process is returned. When the vehicle body operating state v6 is not "during operation" (is "non-operation") (that is, any of the operating levers 17, 18, and 19 is not operated), the rotation speed command v8 is set to the "maximum rotation speed" (for example, 2000 rpm) (S28), the turning stop command pressure v9 is set to the "opening pressure" (for example, 4 MPa) (S29), and the traveling stop command pressure v10 is set to the "opening pressure" (for example, 4 MPa) (S30). That is, in a case where the rotation speed command v8 is the "restricted rotation speed" (that is, the restriction control is performed by the operation restriction function), while the vehicle body operating state v6 is "during operation" (that is, any of the operating levers 17, 18, and 19 is operating), the operation restriction function that performs the restriction control is not disabled (remains to be enabled). After the vehicle body operating state v6 becomes "non-operation" (that is, after any of the operating levers 17, 18, and 19 enters the non-operation state), the restriction control is released to disable the operation restriction function.

In this embodiment, as also described in the process content of the control command (S25) in the non-inclination state described later, basically, when an object is detected, the operation restriction is actuated to perform the restriction control, and the rotation speed command v8 is set to the "restricted rotation speed" (for example, 800 rpm) to slow the operating speed of the vehicle body 50.

By performing the processes depicted in FIG. 9, for example, even when the vehicle body 50 enters the slope ground while an obstacle is detected during traveling on a flat area and the engine rotation speed is restricted to be low due to the operation restriction, the engine rotation speed is remained to be restricted during traveling (that is, the operating lever is operating), and the operation restriction is released at a timing when the traveling operation is ended (that is, after the operating lever is in the non-operation state). Accordingly, the sudden acceleration of traveling unintended by the operator does not occur, and the operator does not have uncomfortable feeling caused by the switching of the restriction release.

Figure 10:
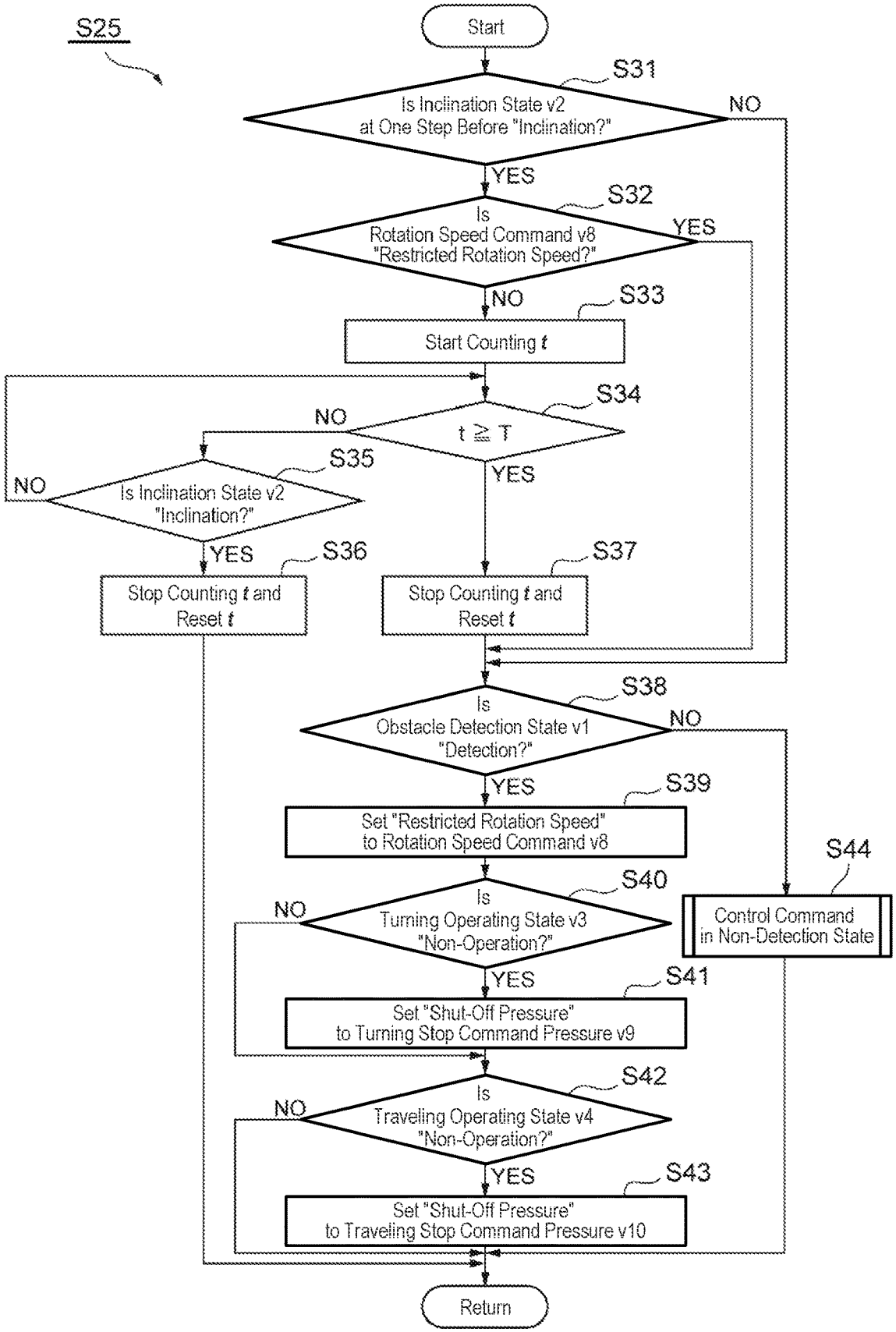
FIG. 10 is a flowchart depicting process content of restriction control in a non-inclination state in a sub-process by the operation restriction command unit.

Detailed Description of Each Control Unit: Sub-Process of Operation Restriction Command Unit FIG. 10 is a flowchart depicting process content of the restriction control in the non-inclination state (S25) in the sub-process by the operation restriction command unit 39.

First, whether the inclination state v2 at one step before is "inclination" (that is, whether the inclination state v2 is immediately after the change from "inclination" to "non-inclination") is determined (S31). When the inclination state v2 at one step before is not "inclination" (is "non-inclination"), the process proceeds to Step S38 at which whether the obstacle detection state v1 transmitted from the detection determination unit 36 is "detection" is determined. In the non-inclination state, whether the obstacle detection state v1 is "detection" is determined (S38). When the obstacle detection state v1 is "detection," the process proceeds to at and after Step S39 to actuate the next operation restriction, and when the obstacle detection state v1 is not "detection" (is "non-detection"), the process proceeds to Step S44 to release the operation restriction. The restriction control in the non-detection state (S44) will be described later. At Step S39, the rotation speed command v8 is set to the "restricted rotation speed" (for example, 800 rpm), and whether the turning operating state v3 is "non-operation" is determined at the next Step S40. When the turning operating state v3 is the "non-operation," the turning stop command pressure v9 is set to a "shut-off pressure" (for example, 0 MPa) (S41), and when the turning operating state v3 is not "non-operation" (is "during operation"), whether the traveling operating state v4 is "non-operation" is determined (S42). When the traveling operating state v4 is "non-operation," the traveling stop command pressure v10 is set to the "shut-off pressure" (for example, 0 MPa) (S43), and when not, the process is returned.

When the turning stop command pressure v9 and the traveling stop command pressure v10 output the "shut-off pressure," the turning and the traveling are unable to move through the process by the solenoid valve control unit 40 described later.

The restriction control to actuate the operation restriction during the obstacle detection is performed through a sequence of the processes from Steps S38 to S44. By lowering the engine rotation speed to the "restricted rotation speed," the obstacle detection is conveyed to the operator through bodily sensation, and continuation of moving the vehicle body 50 in the obstacle detection state is reduced. Furthermore, setting the stop command pressure to the "shut-off pressure" cause the turning and the traveling to be unable to move, thus decreasing a possibility of a contact of the vehicle body 50 with an obstacle at the start of moving of the vehicle body 50. Here, the reason why the stop of the turning and traveling is inactive unless it enters the non-operation state is to avoid the occurrence of a situation of losing the balance by suddenly stopping the turning and/or the traveling during the vehicle body operation.

Subsequently, the process when the inclination state v2 is switched from "inclination" to "non-inclination" (YES at Step S31) will be described. When the inclination state v2 at one step before is determined as "inclination" at Step S31, that is, when the inclination state v2 is switched from "inclination" to "non-inclination," the operation restriction command unit 39 first determines whether the rotation speed command v8 is the "restricted rotation speed" (that is, whether the operation restriction is actuated and the restriction control is performed) (S32). When the rotation speed command v8 is the "restricted rotation speed," in other words, this shows that the inclination state v2 transitions to the non-inclination state from the inclination state while the operation is continued with the operation restriction actuated. In this case, the process immediately moves to the process of actuating and releasing the operation restriction in the non-inclination state at and after Step S38. When the rotation speed command v8 is not the "restricted rotation speed," that is, when the operation restriction function is disabled due to the inclination state, counting of a restriction release duration t starts (S33). Here, as the range of the restriction release duration t, the initial value is set to 0 and the maximum value is set to a determination time T (for example, five seconds). Next, whether the restriction release duration t is the determination time T or more is determined (S34). When the restriction release duration t is less than the determination time T, whether the inclination state v2 becomes "inclination" during the counting of the restriction release duration t is determined (S35). When the inclination state v2 is not "inclination" (when the "non-inclination" is continued), the process returns to Step S34 again and the control state is held until the counted restriction release duration t reaches the determination time T.

That is, in the state of the operation restriction function being disabled, when the inclination state v2 switches from "inclination" to "non-inclination," in other words, when the inclined angle of the vehicle body 50 falls below (has reached) the inclination determination threshold C1 at which the operation restriction function is enabled, the disabled state of the operation restriction function is continued for the predetermined period (the determination time T) after that.

This loop process allows obtaining the following effects. For example, a situation in which when the vehicle body 50 moves from the slope ground where the operation restriction function is disabled to the flat area (non-inclination) by traveling, the slope is detected in the detection range at the rear of the vehicle body when the vehicle body 50 goes down the slope possibly occurs. At this time, when the operation restriction (the reduction in the engine rotation speed) is actuated due to the object detection, the vehicle body 50 is suddenly decelerated, giving uncomfortable feeling to the operator. In this embodiment, the state in which the operation restriction is inactive (the disabled state of the operation restriction function) is maintained for a certain period of time (during the determination time T) after the inclination state v2 switches from "inclination" to "non-inclination" even when an object is detected in the detection range. This eliminates the situation in which the slope at the rear of the vehicle body is detected when the vehicle body 50 that has traveled and gone down the slope ground finished going down the slope, the operation restriction is actuated, and sudden deceleration occurs. This allows avoiding giving uncomfortable feeling due to sudden deceleration unintended by the operator.

After the counted restriction release duration t has reached the determination time T, the counting of the restriction release duration t is stopped and the restriction release duration t is reset (S37), and the state returns to the usual state in which the operation restriction is actuated during the object detection.

Subsequently, a process when the inclination state v2 becomes "inclination" at Step S35 (YES at Step S35) will be described. This process assumes a case where after the vehicle body 50 becomes "non-inclination" from "inclination," the vehicle body 50 becomes "inclination" again during the counting of the restriction release duration t. In this case, since the process need to be returned to the process in the inclination state (at and after S24 of FIG. 9) again, the counting of the restriction release duration t is stopped and the restriction release duration t is reset at the time point of becoming "inclination" (S36), and the control command in the non-inclination state (S25) ends.

Figure 11:
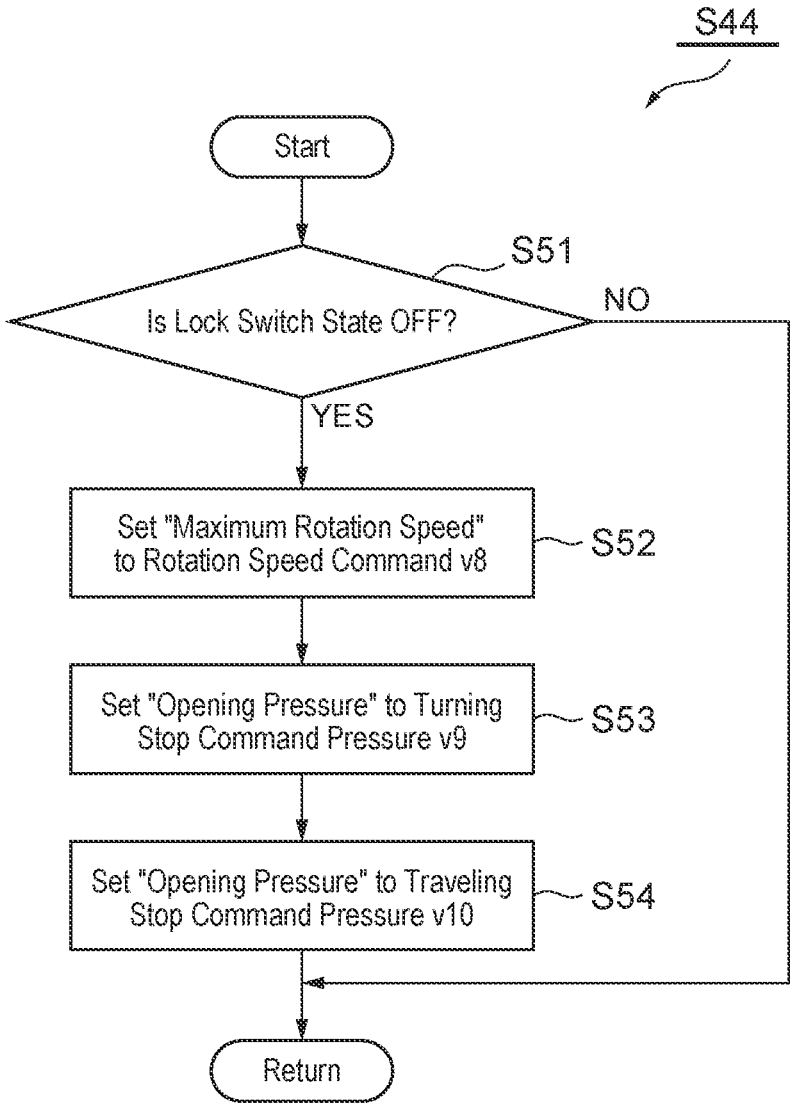
FIG. 11 is a flowchart depicting the process content of the restriction control in a non-detection state in the sub-process of a restriction control process in the non-inclination state by the operation restriction command unit.

FIG. 11 is a flowchart depicting the process content of the restriction control in a non-detection state (S44) in the sub-process of the restriction control process in the non-inclination state by the operation restriction command unit 39.

In the process of this sub-process, the actuation of the operation restriction is released in the non-inclination state. First, whether the lock switch 15 is OFF is determined (S51). When the lock switch 15 is OFF, the rotation speed command v8 is set to the "maximum rotation speed" (for example, 2000 rpm) (S52), the turning stop command pressure v9 is set to the "opening pressure" (for example, 4 MPa) (S53), and the traveling stop command pressure v10 is set to the "opening pressure" (for example, 4 MPa) (S54). When the lock switch 15 is not OFF, the process is returned. When the lock switch 15 is OFF, the lock valve 26 is at the shut-off position, and all of the operations of the vehicle body 50 are disabled. That is, the operation restriction is released here when an object is not detected and the vehicle body 50 is unable to move. This avoids the situation in which any object is not detected while the operating levers 17, 18, and 19 are operated and the operation restriction is released, the vehicle body 50 suddenly starts moving, and the sudden acceleration occurs. Thus, the uncomfortable feeling due to the speed change unintended by the operator can be avoided.

The turning stop command pressure v9 and the traveling stop command pressure v10 as the results of the arithmetic operation by the operation restriction command unit 39 described from FIG. 9 to FIG. 11 are transmitted to the solenoid valve control unit 40 and the rotation speed command v8 is transmitted to the engine rotation control unit 41.

Detailed Description of Each Control Unit: Solenoid Valve Control Unit

Figure 12:
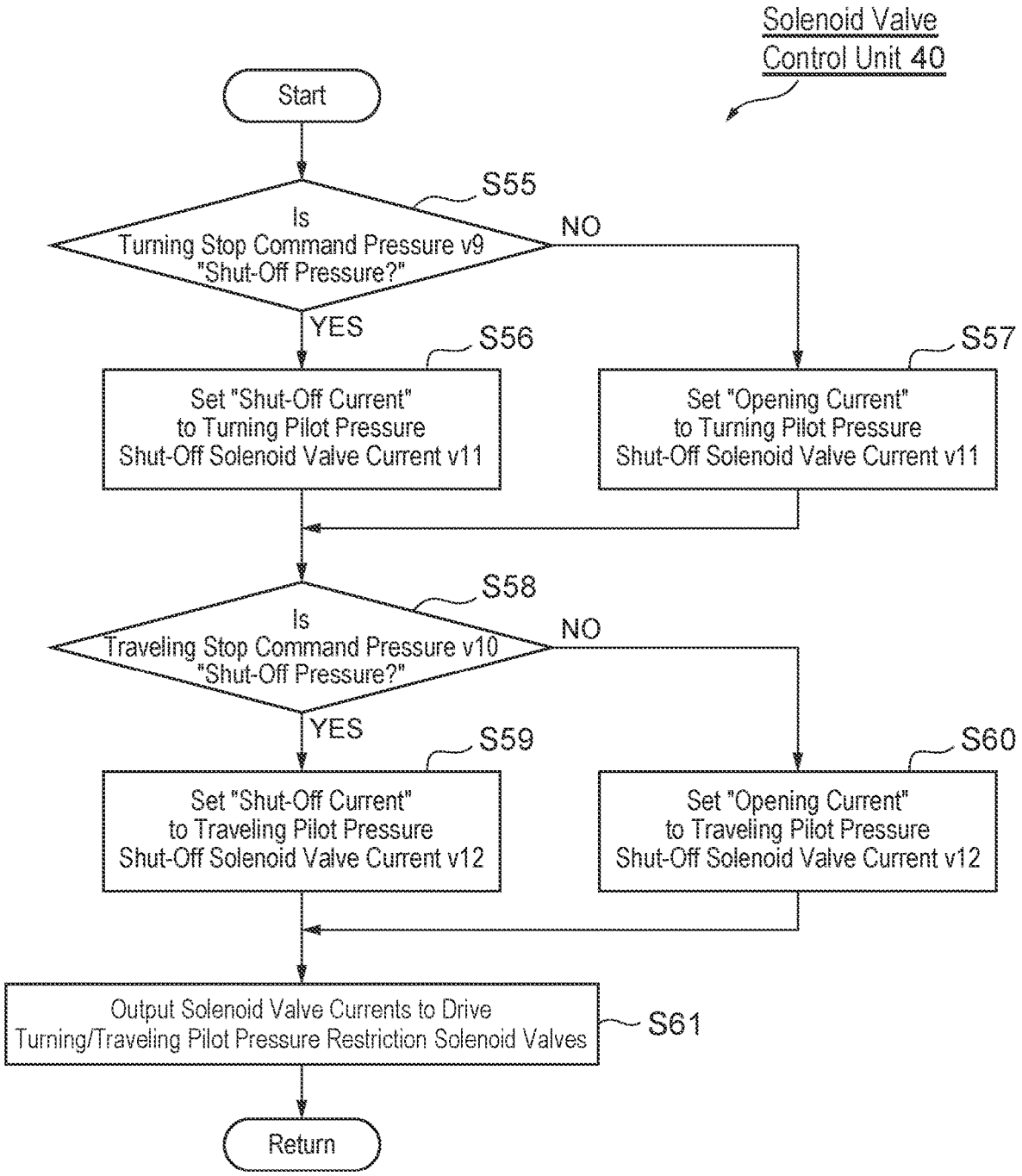
FIG. 12 is a flowchart depicting process content by a solenoid valve control unit.

FIG. 12 is a flowchart depicting process content by the solenoid valve control unit 40.

The solenoid valve control unit 40 is a control unit that actually drives the turning pilot pressure restriction solenoid valve 34 and the traveling pilot pressure restriction solenoid valve 35 as the vehicle body operation restriction means according to solenoid valve pressures of the turning stop command pressure v9 and the traveling stop command pressure v10 as the results of the arithmetic operation by the operation restriction command unit 39.

First, whether the turning stop command pressure v9 transmitted from the operation restriction command unit 39 is the "shut-off pressure" is determined (S55). When the turning stop command pressure v9 is the "shut-off pressure," a turning pilot pressure shut-off solenoid valve current v11 is set to a "shut-off current" (for example, 600 mA) (S56). When the turning stop command pressure v9 is not the "shut-off pressure" (the case of the "opening pressure"), the turning pilot pressure shut-off solenoid valve current v11 is set to an "opening current" (for example, 0 mA) (S57).

Subsequently, whether the traveling stop command pressure v10 transmitted from the operation restriction command unit 39 is the "shut-off pressure" is determined (S58). When the traveling stop command pressure v10 is the "shut-off pressure," a traveling pilot pressure shut-off solenoid valve current v12 is set to the "shut-off current" (for example, 600 mA) (S59). When the traveling stop command pressure v10 is not the "shut-off pressure" (the case of the "opening pressure"), the traveling pilot pressure shut-off solenoid valve current v12 is set to an "opening current" (for example, 0 mA) (S60).

The vehicle body controller 14 builds in a solenoid valve driver as an analog output circuit to drive a solenoid of a proportional solenoid valve, a current is flowed to the circuit such that the currents become the turning pilot pressure shut-off solenoid valve current v11 and the traveling pilot pressure shut-off solenoid valve current v12 to drive the turning pilot pressure restriction solenoid valve 34 and the traveling pilot pressure restriction solenoid valve 35 (S61).

Detailed Description of Each Control Unit: Engine Rotation Control Unit

Figure 13:
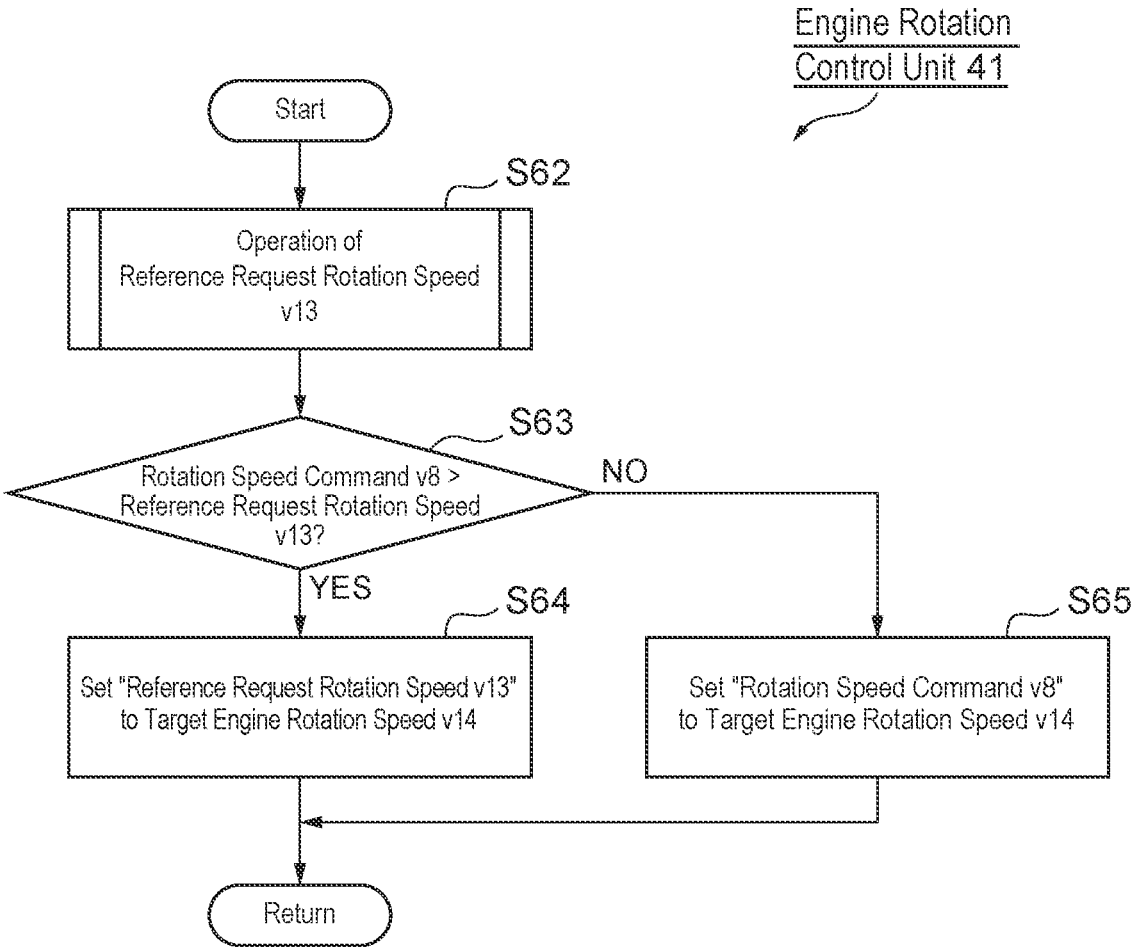
FIG. 13 is a flowchart depicting process content by an engine rotation control unit.

FIG. 13 is a flowchart depicting process content by the engine rotation control unit 41.

The engine rotation control unit 41 selects a request rotation speed according to an engine control dial voltage operated by the operator, a request rotation speed according to amounts of operation of the operating levers 17, 18, and 19, a request rotation speed according to operating environments, such as a radiator water temperature and a hydraulic oil temperature, and the like by preliminarily determined conditions. Finally, the request rotation speed is transmitted as a target engine rotation speed v14 to the engine control device 21 by CAN communication, and thus the actual engine rotation speed requested as the vehicle body 50 is achieved. Although the details are not described in this embodiment, the request rotation speed by the process common to the conventional hydraulic shovel other than the rotation speed command v8 transmitted from the operation restriction command unit 39 is preliminarily operated as a reference request rotation speed v13 by the process in a part not described in FIG. 13 (S62). The rotation speed command v8 and the reference request rotation speed v13 are compared at the final stage of the process by the engine rotation control unit 41.

Subsequent to the arithmetic processing of the reference request rotation speed v13 (S62), the engine rotation control unit 41 determines whether the rotation speed command v8 transmitted from the operation restriction command unit 39 is greater than the reference request rotation speed v13 (S63). While the vehicle body operation restriction is not actuated, the rotation speed command v8 is the "maximum rotation speed" (for example, 2000 rpm) greater than the reference request rotation speed v13. Therefore, in the case, by setting the "reference request rotation speed v13" to the target engine rotation speed v14, the hydraulic shovel 100 is usable as the usual hydraulic shovel 100 (S64). While the vehicle body operation restriction is actuated, the rotation speed command v8 is the "restricted rotation speed" (for example, 800 rpm) at the reference request rotation speed v13 or less. Therefore, in the case, by setting the "rotation speed command v8" to the target engine rotation speed v14, the engine rotation speed is forcibly restricted, and the operation of the vehicle body 50 is restricted (S65).

Effects of Embodiments

As described above, the hydraulic shovel (the construction machine) 100 according to this embodiment includes the vehicle body 50 configured to operate, the 3D sensors (the obstacle detection devices) 5, 6, 7, and 8 that detect an obstacle present around the vehicle body 50, the inclined angle determination device (the inclined angle detection device) 9 that detects the inclined angle of the vehicle body 50, and the vehicle body controller (the controller) 14 having the operation restriction function that performs the restriction control to restrict the operation of the vehicle body 50 when the 3D sensors (the obstacle detection devices) 5, 6, 7, and 8 detect an obstacle. When the inclined angle of the vehicle body 50 exceeds the predetermined threshold (the inclination determination threshold C1) (when the inclination state v2 becomes "inclination") while the restriction control is not performed with the operation restriction function, the vehicle body controller (the controller) 14 disables the operation restriction function. When the inclined angle of the vehicle body 50 exceeds the predetermined threshold (the inclination determination threshold C1) (when the inclination state v2 becomes "inclination") while the restriction control is performed with the operation restriction function, the vehicle body controller (the controller) 14 does not disable the operation restriction function.

Additionally, when the inclined angle of the vehicle body 50 exceeds the predetermined threshold (the inclination determination threshold C1) (when the inclination state v2 becomes the "inclination") while the operation restriction function performs the restriction control, the vehicle body controller (the controller) 14 releases the restriction control to disable the operation restriction function after the operating levers 17, 18, and 19 enter the non-operation state. The operating levers 17, 18, and 19 operate the actuators to cause the vehicle body 50 to operate.

According to this embodiment, in the case where the operation restriction is not actuated when the vehicle body 50 enters the slope ground, the operation restriction function is disabled, and when the operation restriction is actuated, the operation restriction function is not disabled. Additionally, even when the inclined angle of the vehicle body 50 increases during the actuation of the restriction control, the restriction control is not released (the operation restriction function is not disabled) during the operation as described above. For example, after the operator sets the operating levers 17, 18, and 19 to the non-operation state, the restriction control is released to disable the operation restriction function. This allows avoiding the automatic release of the operation restriction involving the sudden acceleration or the like unintended by the operator and giving the uncomfortable feeling caused by it to the operator.

Note that, while the control units in the vehicle body controller 14 perform the restriction control that restricts the operations of the traveling (of the lower traveling body 1) and the turning (of the upper turning body 2) in the above-described embodiments, together with the operations of traveling and turning or instead of the operations of traveling and turning, an operation of the front working machine 3 mounted to the upper turning body 2 may be restricted.

The present invention is not limited to the above-described embodiments and includes various modifications. The above-described embodiments have been explained in detail for easy understanding of the description of the present invention, and do not necessarily include all the explained configurations.

The respective functions of the controllers of the above-described embodiments may be achieved by hardware by designing a part or all of them with, for example, an integrated circuit. The above-described respective functions may be achieved by software with which the processor interprets and executes the programs achieving the respective functions. The programs achieving the respective functions, tables, and information, such as files, can be placed on a storage device, such as a hard disk and a Solid State Drive (SSD) or a recording medium, such as an IC card, an SD card, and a DVD, in addition to the storage devices in the controllers.

REFERENCE SIGNS LIST

1 Lower traveling body
2 Upper turning body
3 Front working machine
3*a* Boom
3*b* Arm
3*c* Bucket
3*d* Boom cylinder (actuator)
3*e* Arm cylinder (actuator)
3*f* Bucket cylinder (actuator)
3*g* Traveling motor (actuator)
3*h* Turning motor (actuator)
4 Driver's cabin
5 3D sensor (obstacle detection device)
6 3D sensor (obstacle detection device)
7 3D sensor (obstacle detection device)
8 3D sensor (obstacle detection device)
9 Inclined angle determination device (inclined angle detection device)
10 Detection region
11 Detection region
12 Detection region
13 Detection region
14 Vehicle body controller (controller)
15 Lock switch
16 Engine control dial
17 Turning operating lever (operating lever)
18 Traveling operating lever (operating lever)
19 Front operating lever (operating lever)
20 Engine
21 Engine control device
22 Hydraulic pump
23 Control valve
24 Hydraulic pressure source
25 Pump regulator
26 Lock valve
27 Pump flow rate control pressure sensor

28 Turning operation pressure sensor
29 Traveling operation pressure sensor
30 Front operation pressure sensor
31 Pump discharge pressure sensor
32 Ambient detection monitor
33 Warning buzzer
34 Turning pilot pressure restriction solenoid valve
35 Traveling pilot pressure restriction solenoid valve
36 Detection determination unit
37 Inclination determination unit
38 Operating state determination unit
39 Operation restriction command unit
40 Solenoid valve control unit
41 Engine rotation control unit
50 Vehicle body
100 Hydraulic shovel (construction machine)

The invention claimed is:

1. A construction machine comprising:

a vehicle body configured to operate;

an obstacle detection device that detects an obstacle present around the vehicle body;

an inclined angle detection device that detects an inclined angle of the vehicle body; and a controller having an operation restriction function that performs a restriction control to restrict an operation of the vehicle body when the obstacle detection device detects an obstacle, wherein when the inclined angle of the vehicle body exceeds a predetermined threshold while the restriction control is not performed with the operation restriction function, the controller disables the operation restriction function, and wherein when the inclined angle of the vehicle body exceeds the predetermined threshold while the restriction control is performed with the operation restriction function, the controller does not disable the operation restriction function.

2. The construction machine according to claim 1, comprising an operating lever that operates an actuator to cause the vehicle body to operate, wherein when the inclined angle of the vehicle body exceeds the predetermined threshold while the restriction control is performed with the operation restriction function, the controller releases the restriction control to disable the operation restriction function after the operating lever enters a non-operation state.

3. The construction machine according to claim 1, wherein the obstacle detection device has a detection region where an obstacle is detected in a range of predetermined depth and width from the vehicle body and a predetermined height above a ground, and wherein the controller uses an angle smaller than the inclined angle of the vehicle body when the detection region is in contact with the ground by inclination of the vehicle body as the threshold to disable the operation restriction function.

4. The construction machine according to claim 1, wherein in a state of the operation restriction function being disabled, the controller continues disabling the operation restriction function for a predetermined period from when the inclined angle of the vehicle body falls below the predetermined threshold.

* * * * *